United States Patent [19]

Ebert et al.

[11] Patent Number: 4,464,850

[45] Date of Patent: Aug. 14, 1984

[54] SHOE INSERT

[75] Inventors: Heinrich Ebert, Abtsteinach; Manfred Noe, Laudenbach; Kurt Wind, Weinheim; Günter Bitsch, Laudenbach, all of Fed. Rep. of Germany

[73] Assignee: Firma Carl Freudenberg, Weinheim/Bergstrasse, Fed. Rep. of Germany

[21] Appl. No.: 396,314

[22] Filed: Jul. 8, 1982

[30] Foreign Application Priority Data

Dec. 9, 1981 [DE] Fed. Rep. of Germany ..... 3148712

[51] Int. Cl.[3] ..... A43B 13/38; A43B 13/40

[52] U.S. Cl. ..... 36/44; 36/43

[58] Field of Search ..... 36/43, 44, 26; 28/107, 28/109

[56] References Cited

U.S. PATENT DOCUMENTS

| | | | |
|---|---|---|---|
| 3,122,141 | 2/1964 | Crowe, Jr. | 28/107 |
| 3,506,529 | 4/1970 | Sanders | 28/107 |
| 4,062,131 | 12/1977 | Hsiung | 36/44 |
| 4,192,086 | 3/1980 | Sichak | 36/44 |
| 4,263,727 | 4/1981 | Bender et al. | 36/44 |

*Primary Examiner*—Werner H. Schroeder
*Assistant Examiner*—Steven N. Meyers
*Attorney, Agent, or Firm*—Kenyon & Kenyon

[57] ABSTRACT

A shoe insert of a cross-linked polyolefin body foamed with closed pores or cells and having a fiber layer arranged on one or both surfaces, the fiber layer consisting of fibers and/or filaments which are distributed over the surfaces in a pattern and which at least partially penetrate the polyolefin body.

18 Claims, 1 Drawing Figure

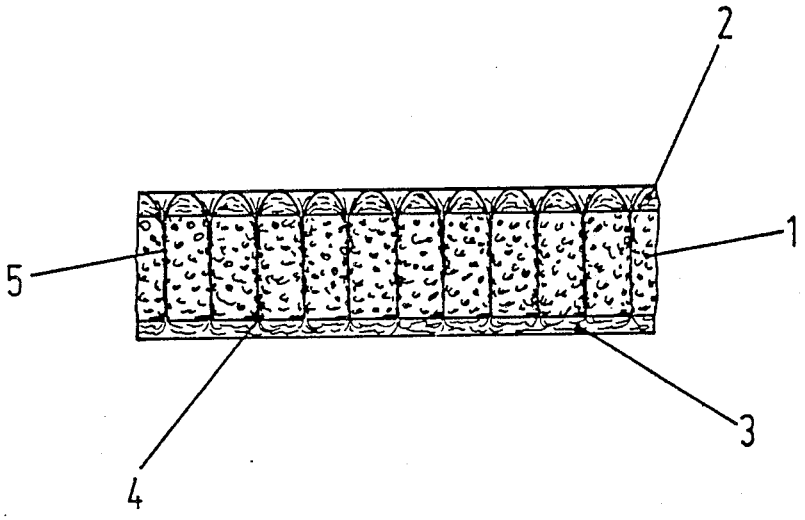
2
1
5
3
4

SHOE INSERT

BACKGROUND OF THE INVENTION

The present invention relates to a shoe insert of a cross-linked polyolefin body foamed with closed cells, having a fiber layer arranged at least on the useful (or working) surface.

Shoe inserts of the type mentioned have been known for a long time. The inserts are distinguished by their good thermal insulation, their high adaptability to the human foot, their ability to damp vibrations and shocks in an excellent manner, and their inertness against aggressive liquids over long periods of time. The shoe inserts are easy to form and can be considered in this respect nearly ideal with respect to fitting orthopedic as well as fashionable footwear.

The moisture absorptivity and the permeability for water vapor of such inserts, however, are extremely low. In particular, if thin stockings of synthetic fiber materials are worn, disagreeable moisture and heat build-up can occur in closed footwear in the region of the sole of the foot after extended use. The desire therefore arose to develop insert soles of the type mentioned in such a manner that in case of heavy perspiration and after an extended period of time, moisture and heat build-up in the vicinity of the sole of the foot is prevented with high reliability. In achieving this aim, of course, it is essential that the earlier-mentioned advantages found in conventional inserts not be impaired in any way.

SUMMARY OF THE INVENTION

According to the present invention, a shoe insert of a cross-linked polyolefin body, foamed with closed cells, and a fiber layer arranged at least on the useful or working surface is provided, in which the fiber layer consists of fibers or filaments which are distributed in pattern-fashion along the surface and which penetrate the polyolefin body either entirely or partly. The fibers or filaments or the narrow gap between them and the surrounding foam material body aid the transport of moisture and water vapor from the area of the working surface to the underside of the insert. From this region, which is typically covered with moisture-permeable materials, good drainage always is assured. The shoe insert according to the present invention ensures for this reason not only good heat insulation and good adaptability to the footwear and to the human foot but, in addition, ensures particularly high wear comfort inasmuch as heat or moisture build-up in the area of the useful surface is reliably avoided. The air permeability (and thereby, the breathing activity) of the insert is distinctly improved.

The fiber layer can be welded or cemented to the surface of the polyolefin body. In either case, a foil-like layer develops between the fiber layer proper and the top side of the polyolefin body, which contributes substantially to stabilizing the insert.

In many cases, however, such stabilization is not desired. For these cases, the fiber layer also can be placed loosely on the top side of the polyolefin body and be joined to the latter only by the fibers or filaments which penetrate the polyolefin body entirely or partially. In this case, the surface has a particularly soft, supple and elastic feel.

The fibers or filaments contain a fairly large number of individual fibers which are united by mutual intertwining, spinning and/or by a bonding agent. The individual fibers of a bundle may have the same or different length.

The textile fiber layer may consist of loosely placed fibers or filaments which are joined together only by fibers or filaments which are drawn into or through the polyolefin body. The abrasion resistance may leave something to be desired in such a case, however, depending on the kind of the fibers or filaments used. It will frequently be preferred, therefore, to employ a fiber layer which has high strength in itself. As particularly suitable has been found the use of woven, knit and/or nonwoven fabrics. The area weight of such fabrics may advantageously be 50 to 250 g/m$^2$ with a thickness of 1 to 3 mm.

The discharge of moisture through the polyolefin body is aided by using a fiber layer having a content of moisture-absorbing fibers or filaments. With increasing moisture content, the thermal conductivity also increased in this case, which is equivalent to a control of the heat transport depending on the exposure. Fibers or filaments of cotton or cellulose have been found to be highly suitable. The planar structure may also exclusively contain fibers or filaments, with particularly high springback elasticity, of hydrophobic materials. The resilience and the soft feel of the surface are thereby preserved over a long period of time, particularly if the fibers or filaments are wrinkled.

Additionally, the fiber layer may contain an organic or inorganic powder. Representative powders useful in the present invention include activated carbon, talcum, barium sulfate, aluminum and silicon dioxide.

The fibers or filaments may have a regularly recurring small distance from each other and may be distributed over the surface in pattern-fashion. The smallest distance between two adjacent fibers or filaments should be at least as large as three-times the fiber or filament thickness but not larger than the thickness of the polyolefin body. The individual fibers or filaments can extend through the polyolefin body so far that the underside of the polyolefin body has freely protruding fiber or filament ends. In this manner, the further transport of the moisture away from the useful surface is ensured in a particularly good way.

Fibers or filaments protruding through the underside of the polyolefin body may be cemented to the underside and to this extent give additional strength to the fiber layer arranged on the useful surface. An equivalent support, together with additionally improved moisture discharge ability can, in addition, be achieved if the fiber or filament ends protruding from the underside of the polyolefin body are joined to an absorption layer attached in this area. The absorption layer may consist of artificial or natural leather, a foam material with open pores or a fiber layer reinforced in itself and/or of cellulose. The absorption layer is placed directly on the backside of the shoe sole itself.

The fibers or filaments can penetrate the polyolefin body not only perpendicularly but also obliquely (and optionally, mutually intersecting each other). The strength of the anchoring of the fiber layer can in this manner be increased. The bulk weight of the cross-linked polyolefin body foamed with closed cells is preferably in the range between 50 and 120 kg/m$^3$. The useful surface of the polyolefin body is preferably adapted orthopedically to the shape of the human foot. The design of the shoe insert can follow the ideal relationships for each size, and the fine fit contributing to the individual wearing comfort results automatically during use.

The shoe insert can be placed subsequently on an absorbing welt of the shoe, for example, by cementing or welding; however, it can also be inserted loosely into the footwear. In the simplest case, the shoe insert consists of a flat structure with plane-parallel surfaces which is cut in accordance with the shape of the cover sole. In addition, however, an orthopedic design is also possible, for example, by heating and deforming with a molding tool in the shape of the human foot. If a fiber layer containing thermally shrinkable fibers is used, the heating required for the deformation is conducted in such a manner that the shrinking forces of the fibers are activated. The anchoring of a fiber layer which initially was placed only loosely on the useful surface is thereby distinctly enhanced during the deformation.

DETAILED DESCRIPTION OF THE INVENTION

The attached drawing shows an example of an embodiment of the shoe insert according to the present invention in a cross-sectional view.

The embodiment shown consists of a cross-linked polyolefin body 1 which is foamed with closed cells and has a bulk weight of 90 kg/m$^3$, a thickness of 7 mm and plane-parallel surfaces. A fiber layer 2 is loosely placed on the working surface of the polyolefin body. This fiber layer consists of a nonwoven fabric which has an area weight of 60 g/m$^2$ and a thickness of 3 mm. The nonwoven fabric consists of 60% cotton fibers and 40% coarse-structured polypropylene fibers.

On the underside of the polyolefin body 1, the ends 4 of the fibers 5 protrude and are bent-over sideways. The ends have an areal portion in contact with the surface of the welt 3 of a leather fiber material cemented to the underside. The welt has a thickness of 1.2 mm and an area weight of 200 g/m$^2$, and is distinguished by particularly high absorptivity for water.

What is claimed is:

1. In a shoe insert consisting of a cross-linked polyolefin body foamed in a closed cell arrangement, and wherein a fiber layer is arranged at least on one surface of said body which will be in contact with the sole of the foot, the improvement comprising providing said fiber layer with hydrophilic fibers and/or filaments which are distributed on said surface in a pattern and which at least in part extend through the polyolefin body and have ends freely protruding through the underside of the body, said ends abutting an adhered layer of absorptive material, whereby moisture may be transferred between said surface layer and said layer of absorptive material.

2. The shoe insert according to claim 1 wherein said fiber layer consists of fibers and/or filament ends which are not connected together.

3. The shoe insert according to claim 1 wherein said fiber layer consists of a member selected from the group consisting of a woven fabric or fabric material, a knit fabric or fabric material and a nonwoven fabric or fabric material.

4. The shoe insert according to claim 1 wherein said fibers or filaments consist of cotton or cellulose.

5. The shoe insert according to claim 3 wherein said fiber layer contains synthetically produced fibers or filaments having high springback elasticity.

6. The shoe insert according to claim 5 wherein said fibers or filaments are wrinkled.

7. The shoe insert according to claim 1 wherein said fiber layer contains fibers and/or filaments selected from the group consisting of metallic mineral and glass fibers and/or filaments.

8. The shoe insert according to claim 1 wherein said fiber layer contains an organic or inorganic powder.

9. The shoe insert according to claim 8 wherein said powder is selected from the group consisting of activated carbon, talcum, barium sulfate, aluminum and silicon dioxide.

10. The shoe insert according to claim 1 wherein said fibers or filaments have a regularly recurring small distance from each other.

11. The shoe insert according to claim 10 wherein the smallest spacing of two fibers or filaments is at least as large as three-times the fiber or filament thickness, and not larger than the thickness of said polyolefin body.

12. The shoe insert according to claim 1 wherein said fiber or filament ends are cemented or welded to a surface of said polyolefin body.

13. The shoe insert according to claim 1 wherein said absorptive layer consists of a member selected from the group consisting of an artificial or natural leather, an open-pore foam material, a fiber layer, and cellulose.

14. The shoe insert according to claim 1 wherein said polyolefin body has a bulk weight of about 20 to 220 kg/m$^3$.

15. The shoe insert according to claim 1 wherein the surface of the polyolefin body which will be in contact with the sole of the foot fits the shape of the human foot.

16. The shoe insert according to claim 1 wherein said polyolefin body consists of a cross-linked polyethylene foamed with closed pores.

17. The shoe insert according to claim 1 wherein said polyolefin body consists of a cross-linked polypropylene foamed with closed pores.

18. The shoe insert according to claim 1 wherein said polyolefin body consists of a cross-linked copolymer of polyethylene and polypropylene material foamed with closed pores.

* * * * *